US005235800A

United States Patent [19]

Slavik et al.

[11] Patent Number: 5,235,800

[45] Date of Patent: Aug. 17, 1993

[54] METHOD AND APPARATUS FOR INITIATION OF SERVICING OPERATIONS IN A TEXTILE SPINNING MACHINE

[75] Inventors: Walter Slavik, Fehraltorf; Giorgio Citterio, Horgen, both of Switzerland

[73] Assignee: Maschinenfabrik Rieter AG, Winterthur, Switzerland

[21] Appl. No.: 823,595

[22] Filed: Jan. 17, 1992

Related U.S. Application Data

[63] Continuation of Ser. No. 582,401, Sep. 13, 1990, abandoned.

[30] Foreign Application Priority Data

Sep. 13, 1989 [CH] Switzerland ..... 03341/89

[51] Int. Cl.[5] ..... D01H 15/02; D01H 13/16

[52] U.S. Cl. ..... 57/264; 57/87; 57/263

[58] Field of Search ..... 57/263, 261, 264, 328, 57/81, 83, 86, 87

[56] References Cited

U.S. PATENT DOCUMENTS

| | | | |
|---|---|---|---|
| 4,043,106 | 8/1977 | Stahlecker | 57/83 X |
| 4,047,371 | 9/1977 | Stahlecker | 57/264 X |
| 4,055,942 | 11/1977 | Stahlecker | 57/263 |
| 4,080,775 | 3/1978 | Stahlecker | 57/263 |
| 4,102,116 | 4/1978 | Derichs et al. | 57/263 |
| 4,689,945 | 11/1987 | Lattion et al. | 57/263 |
| 4,703,617 | 11/1987 | Engeli et al. | 57/264 X |
| 4,821,504 | 4/1989 | Shinkai et al. | 57/264 X |
| 4,838,018 | 6/1989 | Hoeber | 57/263 |
| 4,972,667 | 11/1990 | Oeggerli | 57/83 X |

FOREIGN PATENT DOCUMENTS

| | | | |
|---|---|---|---|
| 1419440 | 12/1975 | United Kingdom . | |
| 2164961 | 4/1986 | United Kingdom | 57/263 |

*Primary Examiner*—Daniel P. Stodola
*Assistant Examiner*—John Rollins
*Attorney, Agent, or Firm*—Wolf, Greenfield & Sacks

[57] ABSTRACT

A textile spinning apparatus comprising an automatic servicing tender and a textile spinning machine having a plurality of spinning stations, the tender being controllably movable into operational alignment with selected stations, the tender including a tender control mechanism for controlling a sequence of tender operations upon operational alignment of the tender with a selected spinning station, the textile spinning machine including a machine control mechanism having a mechanism for receiving an operational alignment signal from the tender and a mechanism for triggering the tender to commence the sequence of tender servicing operations in response to the alignment signal.

11 Claims, 2 Drawing Sheets

METHOD AND APPARATUS FOR INITIATION OF SERVICING OPERATIONS IN A TEXTILE SPINNING MACHINE

This application is a continuation of application Ser. No. 07/582,401, filed Sep. 13, 1990, now abandoned.

BACKGROUND OF THE INVENTION

Spinning machines usually have a large number of spinning units beside another. EP-A-189 516 discloses a rotor spinning machine having an automatic tender which patrols along the machine and stops at any spinning unit where a yarn break has been detected or spinning has to be restarted. To this end, the automatic tender has a manipulator which after a yarn break, hunts for the yarn end on the package and threads it back as far as the rotor or winds a separate yarn on to a new tube and threads it. A critical factor for satisfactory piecing-up is accurate timing of the various operating sequences after the start of piecing up. To this end, EP-A-0 198 516 suggests using a single control device for the tender to control all the movement sequences after the start of piecing up. This process has proved satisfactory. However, there is a deviation in reaction times between the various machine parts serviced by the tender because of manufacturing tolerances between individual spinning units, with a consequent deviation in the length of overlap between the yarn to be pieced up and the newly formed yarn. Since a single tender patrols many spinning units, considerable time may elapse before the tender discovers a spinning unit with a yarn break if the tender has passed by such unit, for example, shortly before the yarn break.

Piecing-up in air jet spinning machines, as described, for example, in DE-PS 3 413 894 and EP-A 0 107 339, is even more difficult since the spinning speeds of air jet machines are considerably greater than those of rotor spinning machines. For an optimal connection between yarn to be pieced up and new yarn the overlap length should be approximately from 2 to 3 times the average fiber length—e.g. approximately 25–75 mm. At a spinning speed of 240 m/min such an overlap length passes by a position in approximately from 6 to 17 ms. The sequence of movements after the start signal of the tender must therefore be accurate to milliseconds if the connection between the two yarn ends is to be satisfactory.

Accordinq to EP-A-0 107 339, some of the machine parts to be moved in the movement sequence after the start of piecing up, are disposed on the spinning unit and others on the tender. Because the delay in actuation may vary from one spinning unit to another and may have a deviation of several milliseconds at least with respect to conventional changeover valves which may be invalid in a piecing operation, actuation of the moving parts of the spinning machine by the control device of the tender is too inaccurate to ensure an overlap length reproducible with sufficient accuracy.

In U.S. Pat. No. 4,821,504 a travelling automatic tender for doffing at several parallel to each other arranged spinning machines is known. The spinning machines are connected to a common control unit, which is connected by way of a signal line with a control unit for the movement of the automatic tender. This common control unit indicates to the second control unit on the tender, in which direction the tender has to be moved. A lamp on the selected spinning machine is releasing the braking operation and the mechanical coupling with the automatic tender. This device is, however, specifically developed for doffing of spinning machines, and is not for controlling servicing manipulations at a single station of a spinning machine, as required, e.g. for piecing after yarn breakage.

It is an object of the invention, therefore, to provide a process and a textile spinning apparatus for precisely effecting servicing operations such as piecing, cleaning, start-up and others with respect to servicing a plurality of spinning units on a single spinning machine.

BRIEF DESCRIPTION OF THE DRAWINGS

An exemplary embodiment of the invention is described hereinafter with reference to the drawings wherein.

DETAILED DESCRIPTION OF PREFERRED EMBODIMENTS

Figure 1:
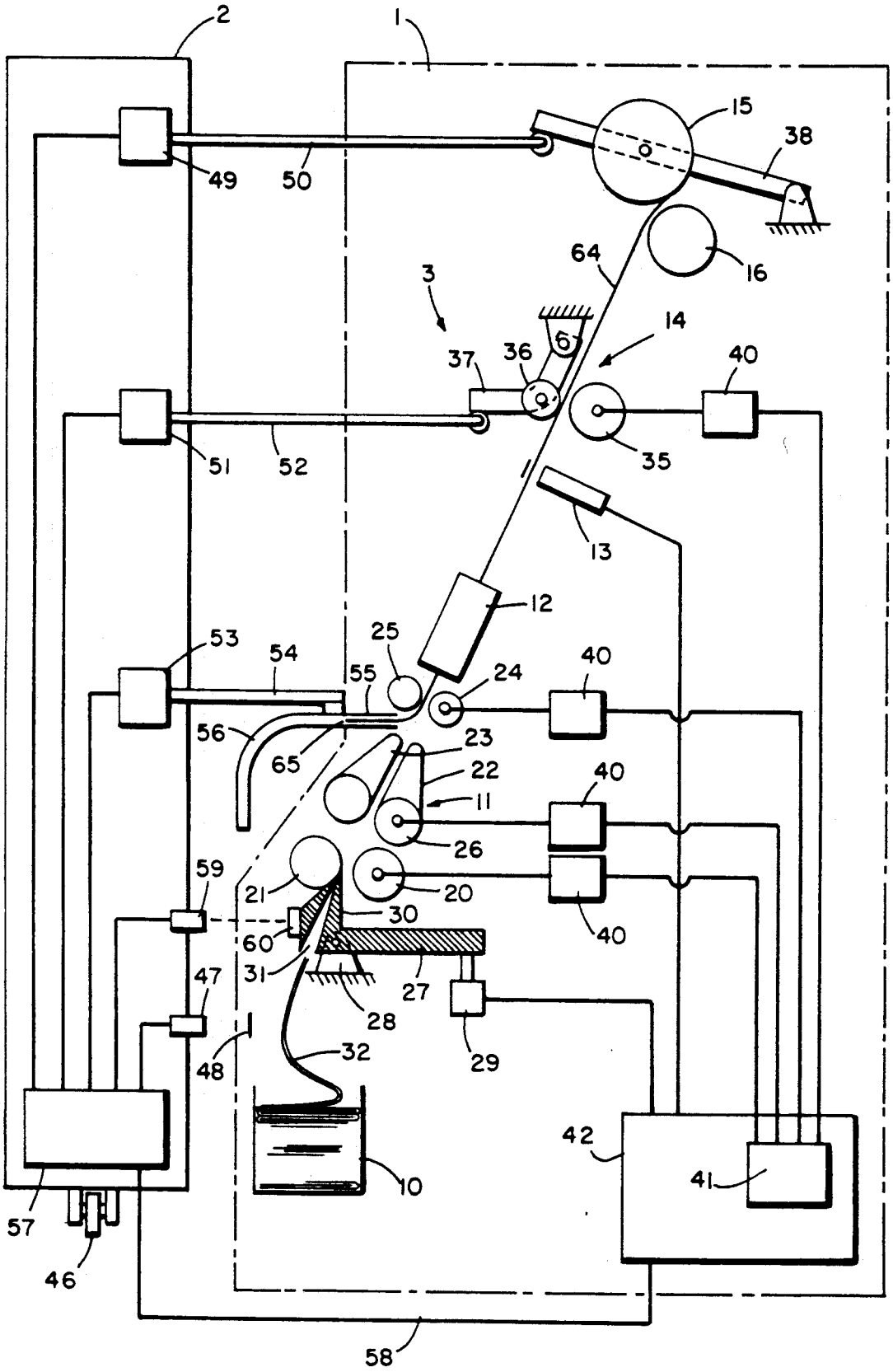
FIG. 1 is a schematic cross section through a spinning machine having an automatic tender.

There is shown in FIG. 1 a textile spinning machine 1 typically having a plurality of identical side-by-side spinning units of of which one spinning unit 3 is shown in diagrammatic cross section in FIG. 1. Each unit 3 comprises, as considered in the direction of yarn movement, a sliver can 10, a drafting unit 11, an air jet nozzle 12, a yarn monitor 13, draw-off rollers 14 and a take up bobbin 15 which in operation bears on a drive roller 16. The drafting unit 11 comprises back rollers 20, 21, two aprons 22, 23 and front rollers 24, 25. A roller 26 drives the apron 22. The rollers 21, 25 and the apron 23 are pressed resiliently on to the rollers 20, 24 and apron 22 respectively. The roller 21 can be disengaged from the roller 20 by a sliver clamp lever 27. The lever 27 is pivotally mounted on a bearing (or pivot point) 28 rigidly secured to the casing and can be pivoted by a solenoid or a pneumatic cylinder 29 from a normal position, in which a finger or the like 30 of the lever 27 is at a distance from the two rollers 21, 22, into an operative position which is shown in FIG. 1 whereby the finger 30 disengages the roller 21 from the roller 20 and brakes the roller 21 with simultaneous clamping of a sliver 32 guided through a passage 31 in the finger 30 between the finger 30 and the surface of the roller 21.

The draw-off rollers 14 comprise a draw-off roller 35 and, pressed resiliently thereagainst, a pressing roller 36 rotatably mounted on a pivoted lever 37. The bobbin 15 is rotatably mounted on another pivoted lever 38. The rollers 20, 24, 26, 35, 16 are connected to and driven by drive shafts which extend the length of the spinning machine and are thus common to all the units 3. The rollers 21, 23, 25 are disposed in pairs and together on a pressing lever (not shown). A pulse transmitter 40 is connected to each of the shafts of the rollers 20, 24, 26, 35. The outputs of the transmitters 40 are connected to a switching circuit 41 of a control device 42 on the spinning machine 1. The monitors 13 of all the units 3 and the solenoids 29 are connected to the control device 42.

The tender 2 is movable along the length of machine 1 on rollers 46 and is initially correctly positioned before the spinning unit to be serviced, for example, by means of a light scanner 47 which scans a positioning mark 48 on the machine 1. The tender 2 has a first actuator 49, which can raise and lower the lever 38 and pressing roller 15 by means of an arm 50, a second actuator 51, which can raise and lower the lever 37 and roller 36 by means of an arm 52, and a manipulator 53, which moves an extraction tube 55 by means of an arm 54. Tube 55 is connected by a hose 56 to a vacuum source (not shown). An automatic control device 57 controls the movements of the actuators 49, 51 and manipulator 53. The device 57 is connected by a signal line 58 to the control device 42. A reflex light scanner 59 is also disposed in the tender 2 and is aligned with a mirror 60 secured to the lever 27. The output of scanner 59 is connected to the control device 57.

The spinning machine 1 described operates as follows: When yarn monitor 13 detects a yarn break at a unit 3, the yarn monitor signal acts by way of the device 42 to energize the corresponding solenoid 29 and also, by way of conventional means on the machine 1 such as shown in accordance with EP patent 0 128 417, to disengage the bobbin 15 from the roller 16 and to brake the bobbin 15. The clamping action between the finger 30 and roller 21 stops the sliver 32 feed. The sliver residue still present between the aprons 22, 23 and the rollers 24, 25 is removed by the still rotating aprons and rollers to an extractor (not shown); the sliver start near the clamping lever 27 and as far as the entry gap between the aprons 22, 23 is combed out and has its cross-section decreased over a length corresponding approximately to from two to three times the average fiber length, a feature which contributes towards optimal joining of the yarn.

The control device 42 of the spinning unit 3 concerned instructs the tender 2 to move from its actual position, for example, at one end or in the middle of the machine 1, to the unit to be serviced. Consequently, in contrast to what is conventional, the tender 2 does not patrol but is brought into use by the control device 42 of the machine.

Figure 2:
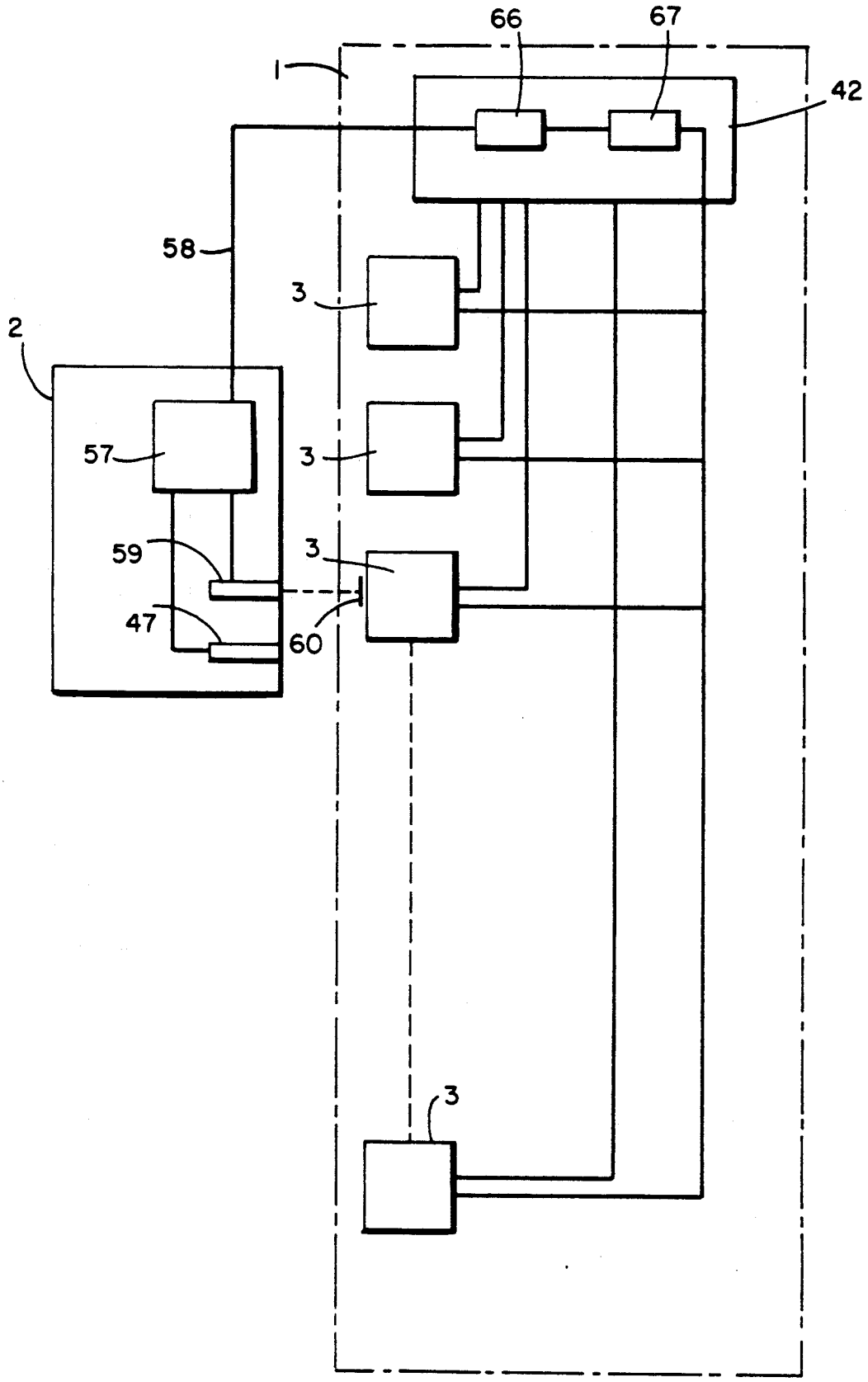
FIG. 2 is a block schematic circuit diagram.

When the tender 2 has taken up its position before the unit 3 to be serviced, the actuator 49 acts by way of the arm 50 to 52 raise the lever 38 and the actuator 51 acts by way of the arm bobbin 15 and detected and, by means of the manipulator 53 and other conventional mechanisms (not shown), threaded back between the rollers 35, 36 and through the monitor 13 and nozzle 12, for example, in the manner described in DE-PS 3 413 894. After such threading, the entry of the extraction tube 55 is disposed laterally adjacent and below the roller 25, to which end the same narrows conically towards this side. This. operative position is shown in FIG. 1, the yarn 64 having been threaded and the yarn end 65 of a predetermined length having been stored in the tube 55. The tender 2 is now ready to start piecing up. The tender 2 reports this readiness to start by way of the line 58 to the control device 42 where this report is stored in a store 66, FIG. 2. When the spinning machine 1 is ready to start, its control device 42 acts to trigger the start, by way of a switching circuit 67 connected to the store 66, by lowering the solenoid 29 of the serviced unit 3. The clockwise pivoting of the lever 27 cancels the clamping which has been preventing movement of the feed sliver 32 and the sliver start is engaged between the rollers 20, 21 and conveyed.

The start signal for the sequence of operations of the tender 2 is delivered by the scanner 59 which detects the movement of the lever 27 without delay. The tender start signal is therefore independent of any delay in operation of the solenoids 29 which may be different between individual units 3. The necessary delays between the movement of the lever 27 and the movement of the tube 55 and arms 50, 52 can therefore be contrived very accurately. After a programmed first delay period (subsequent to the start signed), the lever 37 is lowered by means of the actuator 51 so that the rollers 14 draw off the yarns 64 which have been threaded back as described above. At approximately the same time the lever 38 is lowered by means of the actuator 49 so that the roller 16 drives the bobbin 15. After a programmed second delay period the manipulator 53 pivots the tube 55 laterally so that the same places the yarn in the entry nip between the rollers 24 and 25. The first and second delay periods are so calculated that the yarn end 65 has an approximately 2–3 average fiber length such as 25 to 75 mm overlap with the sliver start.

Both of the delay periods may be calculated from the speeds of the shafts driving the rollers 20, 24, 26, 35. This is the function of the transmitters 40 and circuit 41. The latter ensures that the overlap length is independent of the setting of the machine 1.

The automatic tender 2 hereinbefore described is of use not only for air jet spinning machines but can also be used similarly and very advantageously for servicing draw frames in other spinning systems, for example, in ring spinning machines.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A textile spinning apparatus comprising an automatic servicing tender and a textile spinning machine having a plurality of spinning stations each having a sliver feed mechanism movable between a sliver stop and feed position, the tender being controllably movable into operational alignment with selected stations, the tender including a tender control mechanism for controlling a sequence of servicing operations including piercing operations upon and after operational alignment of the tender with a selected spinning station, the textile spinning machine including a machine control means having means for receiving an operational alignment signal from the tender and means for signalling a sliver feed mechanism at the selected spinning station to move from a sliver stop to a sliver feed position after receipt of the operational alignment signal, the movement of the sliver feed mechanism triggering the tender to commence the sequence of piecing operations, the tender including means for sensing movement of the sliver feed mechanism, the sensing means being connected to the tender control means for sending a start signal to the tender control means in response to movement of the sliver feed mechanism, the tender control means initiating the sequence of piecing operations upon receipt of the start signal from the sensing means.

2. The apparatus of claim 1 wherein the sensing means comprises a light sensitive mechanism.

3. The apparatus of claim 1 wherein the spinning stations include means for detecting a yarn break, the means for detecting being connected to the machine control means for signalling the machine control means upon detection of a yarn break at a spinning station, the machine control means including means for signalling the tender in response to receipt of a yarn break signal from a detection means corresponding to the spinning station at which a yarn break is detected.

4. The apparatus of claim 1 wherein the spinning stations include a drafting unit having a pair of sliver delivery roller resiliently pressed against each other, the sliver feed mechanisms including means for delivering a sliver to between the rollers, the means for delivering being movable into engagement with at least one of the rollers to resiliently disengage the one roller from the other and clamp the sliver against delivery by the sliver delivery means.

5. The apparatus of claim 4 wherein the sliver delivery means is movable out of engagement with the one roller such that the sliver delivery means is rendered operational, the sensing means sensing such movement and sending the start signal to the tender control means in response thereto.

6. A textile spinning apparatus comprising an automatic servicing tender and a textile spinning machine having a plurality of spinning stations each having a sliver feed mechanism movable between a sliver stop and feed position, the tender being controllably movable into operational alignment with selected stations, the tender including a tender control mechanism for controlling a sequence of servicing operations including piecing operations upon and after operational alignment of the tender with a selected spinning station, the textile spinning machine including a machine control means having means for receiving an operational alignment signal from the tender and means for signalling a sliver feed mechanism at the selected spinning station to move from a sliver stop to a sliver feed position after receipt of the operational alignment signal, the tender including means for sensing the movement of the sliver feed mechanism and means for triggering the tender to commence the piecing operations upon sensing of movement of the sliver feed mechanism from a stop to a feed position.

7. The apparatus of claim 6 wherein the means for receiving the alignment signal comprises a memory connected to the means for triggering, the means for triggering comprising a switching circuit connected to the tender control mechanism.

8. The apparatus of claim 6 wherein the spinning stations include means for detecting a yarn break, the means for detecting being connected to the machine control means for signalling the machine control means upon detection of a yarn break at a spinning station, the machine control means including means for signalling the tender in response to receipt of a yarn break signal from a detection means corresponding to the spinning station at which a yarn break is detected.

9. The apparatus of claim 6 wherein the spinning stations include a drafting unit having a pair of sliver delivery rollers resiliently pressed against each other, the sliver feed mechanisms including means for delivering a sliver to between the rollers, the means for delivering being movable into engagement with at least one of the rollers to resiliently disengage the one roller from the other and clamp the sliver against delivery by the sliver delivery means.

10. The apparatus of claim 9 wherein the sliver delivery means is movable out of engagement with the one roller such that the sliver delivery means is rendered operational, the sensing means sensing such movement and sending the start signal to the tender control means in response thereto.

11. Process for restarting a spinning operation through a sequence of piecing operations performed by an automatic servicing tender movably mounted on a textile spinning machine having a plurality of spinning stations each having a sliver feed mechanism movable between a stop and a feed position, the tender being controllably alignable with selected spinning stations, the tender including means for sensing movement of a sliver feed mechanism, the process comprising:

providing a signal from the machine to the tender instructing the tender to align with a selected spinning moving the sliver feed mechanism at the selected spinning station from a stop to a feed position after alignment of the tender with the selected spinning station;

detecting the movement of the sliver feed mechanism from the stop to the feed position with the sensing means;

triggering the tender to begin the sequence of thread joining operations at the selected spinning station upon detection of the movement of the sliver feed mechanism by the sensing means.

* * * * *